US006561614B1

(12) United States Patent
Therien et al.

(10) Patent No.: US 6,561,614 B1
(45) Date of Patent: May 13, 2003

(54) INK SYSTEM CHARACTERISTIC IDENTIFICATION

(75) Inventors: Patrick J. Therien, Battle Ground, WA (US); Wen-Li Su, Vancouver, WA (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 10/003,397

(22) Filed: Oct. 30, 2001

(51) Int. Cl.[7] ..... B41J 29/393
(52) U.S. Cl. ..... 347/19
(58) Field of Search ..... 347/19, 14, 23, 347/12, 10, 11, 15, 6, 53, 54, 20

(56) References Cited

U.S. PATENT DOCUMENTS 6,056,386 A 5/2000 Nohata et al.
6,086,190 A 7/2000 Schantz et al.
6,322,193 B1 * 11/2001 Lian et al. ..... 347/19

* cited by examiner

*Primary Examiner*—Raquel Yvette Gordon
*Assistant Examiner*—Charles W. Stewart, Jr.
(74) *Attorney, Agent, or Firm*—Christopher B. Milller

(57) ABSTRACT

An ink drop detector includes a sensing target which is imparted with an electrical stimulus when struck by at least one ink drop burst which has been ejected from an ink drop generator. The detector also includes electronics coupled to the sensing target which characterize the electrical stimulus in terms of a mathematical phase. Methods for analyzing ink ejected from an ink drop generator, and a method for optimizing ink drop generator firing frequency are also provided.

54 Claims, 6 Drawing Sheets

INK SYSTEM CHARACTERISTIC IDENTIFICATION

Printing mechanisms, such as inkjet printers or plotters, often include an inkjet printhead which is capable of forming an image on many different types of media. The inkjet printhead ejects droplets of colored ink through a plurality of orifices and onto a given media as the media is advanced through a printzone. The printzone is defined by a plane created by the printhead orifices and any scanning or reciprocating movement the printhead may have back-and-forth and perpendicular to the movement of the media. Conventional methods for expelling ink from the printhead orifices, or nozzles, include piezo-electric and thermal techniques which are well-known to those skilled in the art. For instance, two earlier thermal ink ejection mechanisms are shown in U.S. Pat. Nos. 5,278,584 and 4,683,481, both assigned to the present assignee, the Hewlett-Packard Company.

In a thermal inkjet system, a barrier layer containing ink channels and vaporization chambers is located between a nozzle orifice plate and a substrate layer. This substrate layer typically contains columnar arrays of heater elements, such as resistors, which are individually addressable and energized to heat ink within the vaporization chambers. The energy which is applied to a given resistor to heat the ink to the point of drop ejection is referred to as the turn-on energy. Upon heating, an ink droplet is ejected from a nozzle associated with the energized resistor.

A printing mechanism may have one or more inkjet printheads, corresponding to one or more colors, or "process colors" as they are referred to in the art. For example, a typical inkjet printing system may have a single printhead with only black ink; or the system may have four printheads, one each with black, cyan, magenta, and yellow inks; or the system may have three printheads, one each with cyan, magenta, and yellow inks. Of course, there are many more combinations and quantities of possible printheads in inkjet printing systems, including seven and eight ink/printhead systems.

Each process color ink is ejected onto the print media in such a way that size, relative position of the ink drops, and color of a small, discreet of process inks are integrated by the naturally occurring visual response of the human eye to produce the effect of a large colorspace with millions of discernable colors and the effect of a nearly continuous tone. In fact, when these imaging techniques are performed properly by those skilled in the art, near-photographic quality images can be obtained on a variety of print media using only three to eight colors of ink.

This high level of image quality depends on many factors, several of which include: consistent and small ink drop size, consistent ink drop trajectory printhead nozzle to the print media, and extremely reliable inkjet printhead nozzles which do not clog. Ink drop detectors may be employed in a printing mechanism to monitor nozzles for clogging, but it would be useful to also monitor drop size and trajectory. More specifically, it would be beneficial to be able to measure the numerous factors which affect ink drop size and trajectory.

Therefore, it is desirable to have a method and mechanism for effectively, efficiently, and economically measuring ink system characteristics which affect ink drop size and trajectory, such as viscosity, electrical conductivity, dye load, surface tension, drop firing turn-on energy, drop velocity, and ink age.

DETAILED DESCRIPTION OF THE PREFERRED EMBODIMENTS

Figure 1:
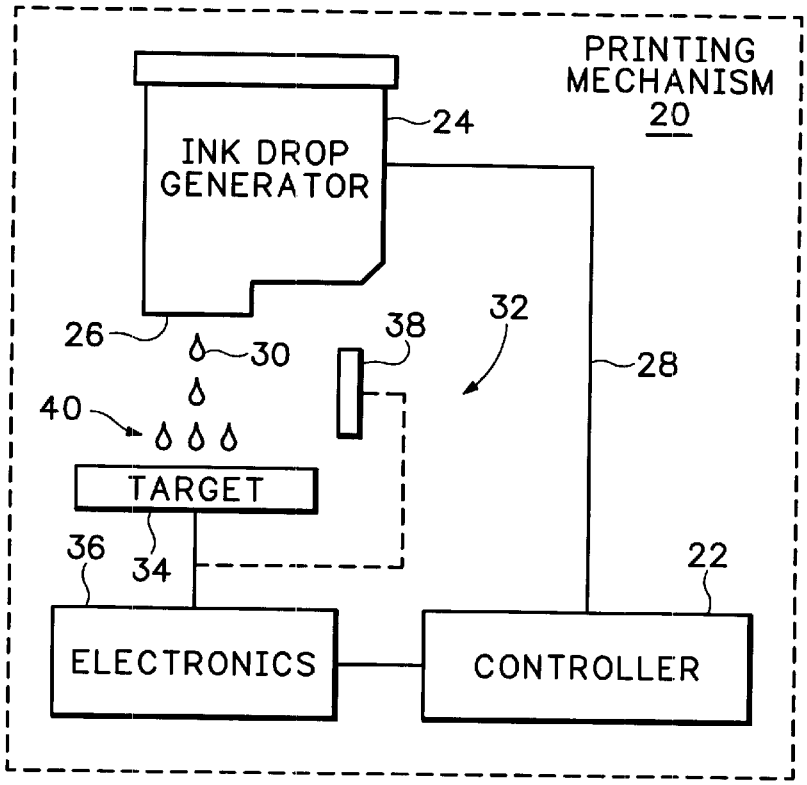
FIG. 1 is a schematic diagram illustrating one embodiment of a printing mechanism which may employ embodiments of a drop detection system to identify ink system characteristics.

FIG. 1 schematically illustrates an embodiment of a printing mechanism, here shown as an inkjet printer 20, constructed in accordance with the present invention, which may be used for printing on a variety of media, such as paper, transparencies, coated media, cardstock, photo quality papers, and envelopes in an industrial, office, home or other environment. A variety of inkjet printing mechanisms are commercially available. For instance, some of the printing mechanisms that may embody the concepts described herein include desk top printers, portable printing units, wide-format printers, hybrid electrophotographic-inkjet printers, copiers, cameras, video printers, and facsimile machines, to name a few. For convenience the concepts introduced herein are described in the environment of an inkjet printer 20.

While it is apparent that the printer components may vary from model to model, the typical inkjet printer 20 includes printer control electronics, illustrated schematically as a controller 22 that receives instructions from a host device, such as a computer or personal digital assistant (PDA) (not shown). Printer host devices, such as computers and PDA's are well known to those skilled in the art.

The typical inkjet printer 20 will include an ink drop generator 24 which is capable of ejecting drops of ink onto a print media. Ink drop generator 24 may be configured to work with pigment based inks or dye based inks. The dye and pigment based inks may be of different colors, such as, for example, black, cyan, magenta, or yellow. The printing mechanism 20 may contain a single drop generator 24 for use with a single color of ink; multiple ink drop generators 24, each for use with a single color of ink; a single drop generator 24 for use with multiple colors of ink; multiple drop generators 24, each for use with multiple colors of ink; or a combination of drop generators 24 where at least one is for use with a single color of ink and at least one is for use with multiple colors of ink. It is apparent that other types of inks may also be used in the ink drop generators 24, such as paraffin-based inks, as well as hybrid or composite inks having both dye and pigment characteristics. A printing mechanism 20 may have replaceable ink drop generators 24 where each drop generator 24 has a reservoir that carries the entire ink supply as the drop generator 24 reciprocates over the print media. As used herein, the term "ink drop generator" may also refer to an "off-axis" ink delivery system, having main stationary reservoirs (not shown) for each ink (black, cyan, magenta, yellow, or other colors depending on the number of inks in the system) located in an ink supply region. In an off-axis system, the ink drop generators 24 may be replenished by ink conveyed through a flexible tubing system from the stationary main reservoirs which are located "off-axis" from the path of ink drop generator 24 travel, so only a small ink supply is propelled while printing. Other ink delivery or fluid delivery systems may also employ the systems described herein, such as replaceable ink supplies which attach onto ink drop generators having permanent or semi-permanent print heads.

Each ink drop generator 24 has an orifice plate with a plurality of nozzles formed therethrough in a manner well known to those skilled in the art. The nozzles of each ink drop generator 24 are typically formed in at least one, but typically two columnar arrays along the orifice plate. Thus, the term "columnar" as used herein may be interpreted as "nearly columnar" or substantially columnar, and may include nozzle arrangements slightly offset from one another, for example, in a zigzag arrangement. The ink drop generator 24 is illustrated as having a thermal inkjet printhead 26, although other types of printheads, or ink drop generators may be used, such as piezoelectric printheads. The thermal printhead 26 typically includes a plurality of resistors which are associated with the nozzles. Upon energizing a selected resistor, a bubble of gas is formed which ejects a droplet 30 of ink from the nozzle. The printhead 26 resistors are selectively energized in response to firing command control signals 28 delivered from the controller 22 to the ink drop generator 24.

FIG. 1 also schematically illustrates an ink drop detector 32. The ink drop detector 32 includes a conductive target 34 which is electrically coupled to electronics 36. Electronics 36 provide a bias voltage to the conductive target 34. Alternatively, a biasing plate 38 may be used in addition to target 34, with the electronics 36 providing the biasing voltage to the biasing plate 38. An electric field is created by the bias voltage, causing a charge to build up on ink droplets 30 as they leave the printhead 26. In order to make a drop detection measurement, the printhead 26 is positioned over the target 34, and thereafter the ink droplets 30 may be ejected, charged, and detected according to the apparatus and method described in U.S. Pat. No. 6,086,190, assigned to the Hewlett-Packard Company, the present assignee.

The target 34 may also be coupled to filtering electronics and an amplifier which are part of electronics 36. The charged ink droplets 30 induce an electrical stimulus, such as a current spike, when they contact the target 34, and this current spike may be sensed and amplified by the electronics 36. For efficiency, a grouping of printhead 26 nozzles are typically fired together in one ink burst 40 over the target 34. Although ink burst 40 is illustrated as a group of three ink droplets 30 in FIG. 1, any number of ink droplets may be included in an ink drop burst 40.

Figure 2:
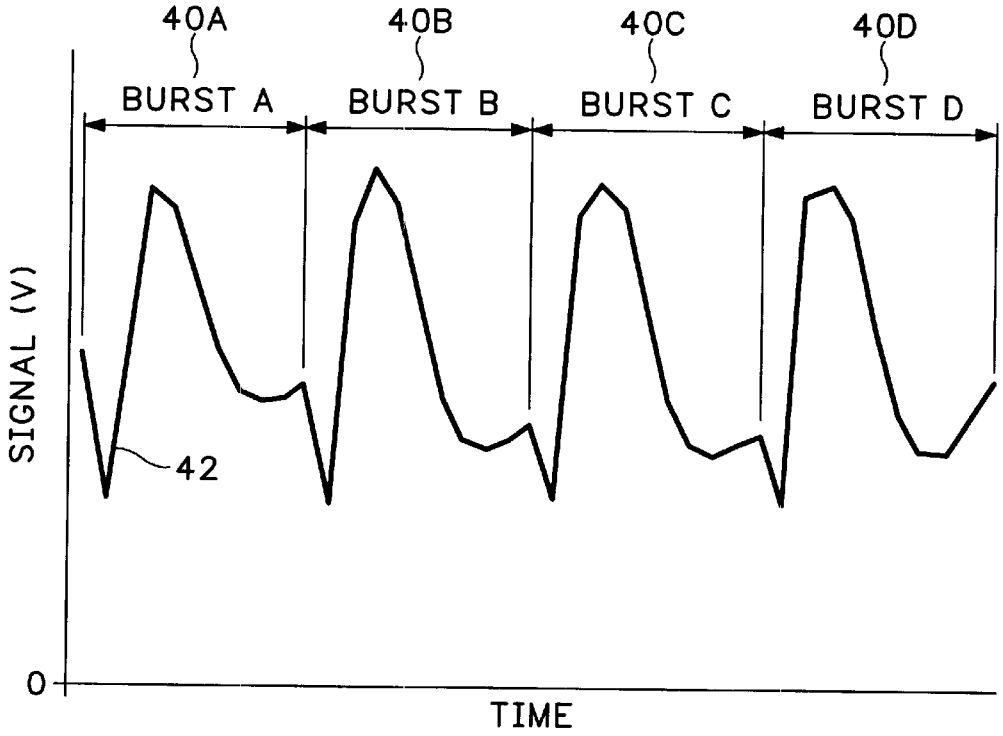
FIG. 2 is a graph illustrating a possible voltage signal which may result from bursts of ink droplets as detected by a drop detection system.

As illustrated in FIG. 2, when a series of ink drop bursts 40 are fired onto the target 34, a signal voltage 42 proportional to the current spikes from the charged ink bursts 40 will be generated by the electronics 36. Signal voltage 42, as illustrated in FIG. 2, may be subdivided into separate ink drop burst 40 sections: Ink burst 40A, ink burst 40B, ink burst 40C, and ink burst 40D. Of course, controller 22 may instruct the ink drop generator 24 to fire any number of ink bursts 40 onto the target 34, and the fact that there are four ink drop bursts 40 illustrated in FIG. 2 is merely for sake of example. Based on the timing between the initiation of consecutive ink bursts 40, the controller 22, which is coupled to electronics 36, will be able to sample the signal voltage 42 and separately examine each ink drop burst 40. Alternatively, an average of separate ink drop bursts 40 may be taken before sampling the voltage signal to increase accuracy. For simplicity, however, the description of this embodiment only discusses sampling a single ink drop burst, although average signals of multiple ink drop bursts are meant to be included as well.

Figure 3:
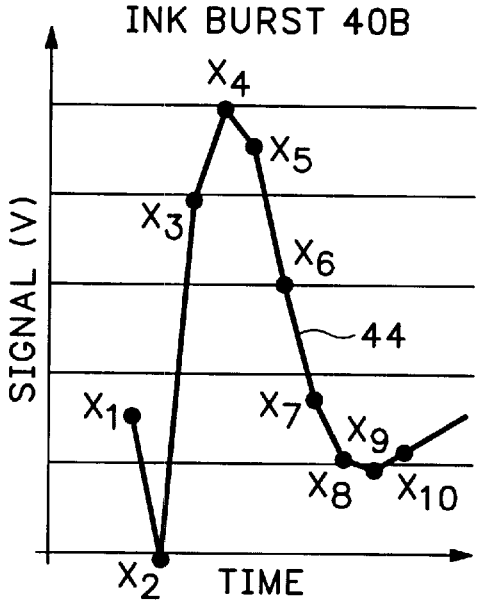
FIG. 3 is a graph illustrating a subset of the voltage signal in FIG. 2, corresponding to a single burst of ink drops.

FIG. 3 shows the signal voltage 44 corresponding to ink burst 40B from FIG. 2. Controller 22 may analyze each ink burst 40 separately or the controller may analyze an average of multiple ink bursts 40. An analog-to-digital converter which is part of electronics 36 or controller 22 will sample signal voltage 44 at a predetermined frequency or frequencies which are chosen to avoid aliasing with the burst frequency and to provide an accurate picture of the ink burst 40 signal curve 44. In the example of FIG. 3 and for the sake of illustration, ten sampled data points, $X_1$ through $X_{10}$, were taken from the signal voltage 44 which corresponds to ink burst 40B. The appropriate number of sample points may be determined based on the needs of a given system, but for simplicity, ten sampled data points $X_1$ through $X_{10}$ are illustrated in FIG. 3. By taking the sample points $X_1$–$X_{10}$ at substantially equal intervals, we can apply a digital signal processing technique, such as a Fourier Transform, to the sample points $X_1$–$X_{10}$ to calculate an Electrostatic Drop Detect (EDD) Score 46 (illustrated and discussed later with regard to FIGS. 4A, 4B, 6 and 7) which corresponds to a vector and we may also calculate an EDD Phase 48 (illustrated and discussed later with regard to FIGS. 5A, 5B, 6, and 7), based on the signal position within the ink burst signal curve 44. Although the sample points $X_1$ through $X_{10}$ are illustrated in FIG. 3 as being equally spaced, a Fourier Transform could be applied effectively in some applications when the sample points are not equally spaced. The EDD Score 46 and the EDD Phase 48 may be calculated, for example, with the following formulae:

$$EDD\ Phase = \tan^{-1}\left[\frac{\beta}{\alpha}\right]$$

$$\alpha = \sum_{n=1}^{M} (X_n \cdot \cos(n))$$

$$\beta = \sum_{n=1}^{M} (X_n \cdot \sin(n))$$

and where M equals the number of sample data points taken in the burst. In the example illustrated in FIG. 3, there are ten sample data points $X_1$–$X_{10}$. Also note that EDD Phase 48 (a mathematical phase) may be represented by using the phase ratio of $[\beta/\alpha]$, depending on the application, rather than taking the arc tan of $[\beta/\alpha]$.

Figure 4A:
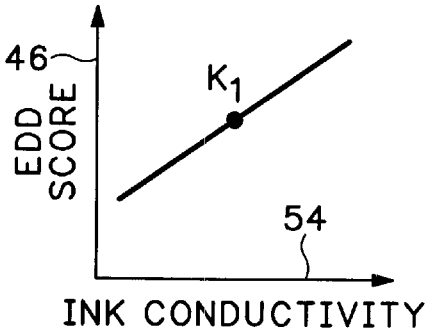
FIGS. 4A and 4B illustrate possible graphs of ink system characteristics such as conductivity and drop size, respectively, versus a determined electrostatic drop detection score.
Figure 4B:
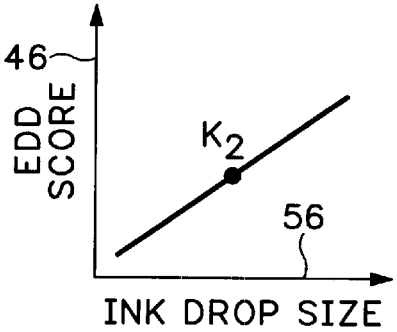

The EDD Score 46 and the EDD Phase 48 associated with a particular ink drop burst 40 can be correlated with particular characteristics of an ink system. As FIGS. 4A and 4B illustrate, characteristics such as ink electrical conductivity 54, and ink drop size 56 have a relationship with the EDD Score 46. As each ink droplet 30 in an ink drop burst 40 is being ejected over the conductive target 34, the ink droplets 30 will tend to accumulate a charge on their surface as the presence of the electric field from the biasing voltage effects a shift of electrons. When the ink droplets 30 break off, the charge which has accumulated thereon is held on the droplets 30. The higher the total charge on the ink droplets 30 in an ink drop burst 40, the higher the corresponding EDD Score 46 will be for a given ink drop burst 40. The more conductive an ink formulation is, the easier it will be for charge to build up on the surface of an ink droplet 30 of that formulation. Therefore, as FIG. 4A illustrates, EDD Score 46 will have a direct relationship with ink conductivity 54. As ink conductivity 54 increases above some known point K1, the corresponding EDD Score 46 will also increase. If the conductivity 54 were to decrease below known point K1, then the corresponding EDD Score 46 would also decrease. Similarly, the larger an ink droplet 30 is, the more charge it can hold. Therefore, as FIG. 4B illustrates, EDD Score 46 will have a direct relationship with ink drop size 56. As ink drop size 56 increases above some known point K2, the corresponding EDD Score 46 will also increase. If the drop size 56 were to decrease below known point K2, then the corresponding EDD Score 46 would also decrease. Additionally, if the density of the ink is known, then drop weight may also be calculated from a known drop size 56.

Figure 5A:
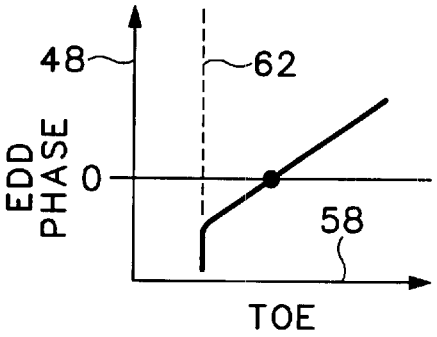
FIGS. 5A and 5B illustrate possible graphs of ink system characteristics such as velocity and turn-on-energy, respectively, versus a determined electrostatic drop detection phase.
Figure 5B:
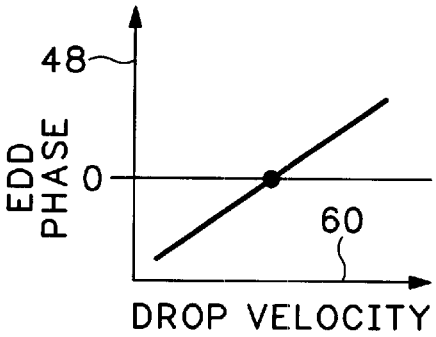

As FIGS. 5A and 5B illustrate, ink system characteristics, such as ink turn-on-energy (TOE) 58 and drop velocity 60, have a relationship with the EDD Phase 48. Turn-on-energy (TOE) 58 refers to the amount of power which is applied to a resistor in a printhead 26 to vaporize part of the ink in the printhead, thereby creating a bubble of gas in the printhead 26. The gas expands, forcing an ink droplet 30 out of the printhead 26. If the energy placed into the resistor is not sufficient to vaporize the ink, no gas bubble will form and no ink will be ejected. The minimum turn-on-energy is defined as the minimum amount of energy necessary to cause a droplet 30 of ink to eject from a printhead 26. As FIG. 5A illustrates, at a low TOE, there will be no ejection of ink, therefore no EDD Phase 48 is calculable. Once a minimum TOE level 62 is reached, ink droplets 30 will be formed and ejected from the printhead 26. An EDD Phase 48 may be calculated as indicated above and plotted versus TOE 58. TOE 58 levels may be increased above the minimum TOE level 62, and as FIG. 5A illustrates, the EDD Phase 48 will increase with increases in TOE 58. As TOE 58 increases, ink droplets 30 will be ejected from the printhead 26 with more velocity 60. As FIG. 5B illustrates, droplets 30 with higher velocities will result in an increase in EDD Phase 48. Since velocity 60 tracks with TOE 58, the EDD Phase 48 will also increase with increasing TOE 58, provided the minimum TOE level 62 has been reached.

Figure 6:
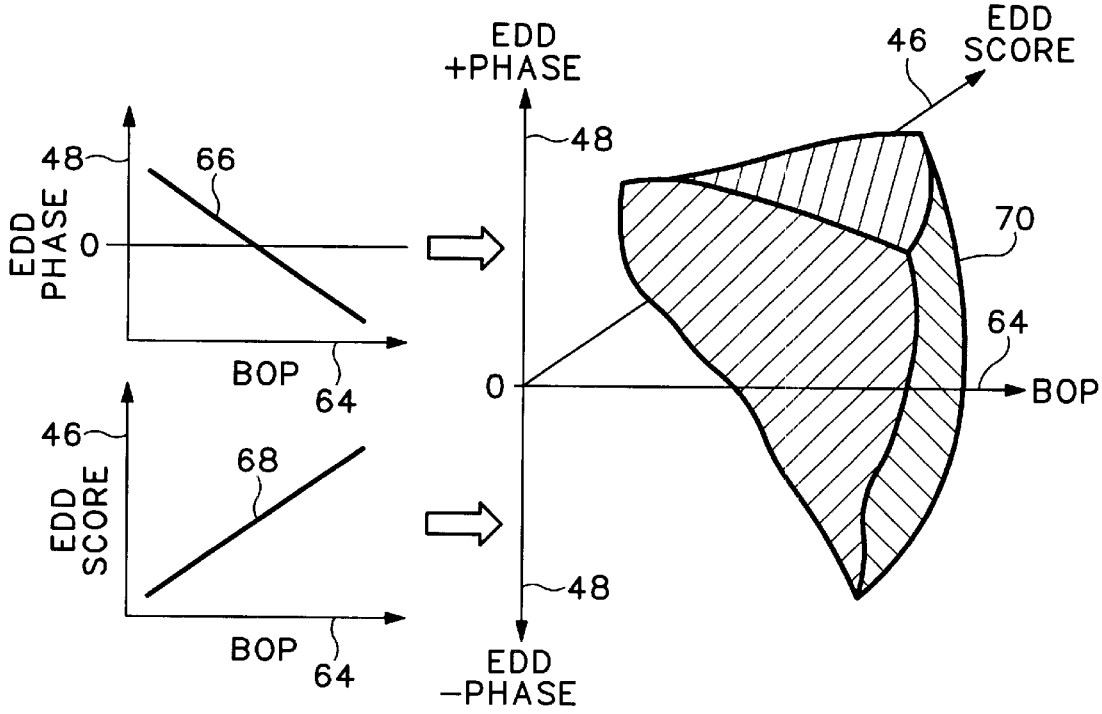
FIG. 6 illustrates possible graphs of ink system characteristics such as break-off-point versus a determined electrostatic drop detection score and versus a determined electrostatic drop detection phase.

FIG. 6 illustrates an ink system characteristic, break-off-point (BOP) 64 which can be measured by both changes in EDD Phase 48 and EDD Score 46. Break-off-point (BOP) 64 takes into account ink properties such as viscosity, surface tension, dye load, and age of the ink. A small or short BOP 64 indicates that an ink droplet has broken free of the printhead 26 more quickly than the a droplet 30 with a high or long BOP 64. A droplet 30 which breaks free of the printhead 26 in a shorter time, will tend to have an apparently higher velocity traveling from the printhead 26 to the conductive target 34. A droplet 30 which takes longer to break free of the printhead 26 will have an apparently lower velocity. Thus, the EDD Phase 48 versus BOP 64 curve 66 in FIG. 6 has an inverted relationship to the EDD Phase 48 versus velocity 60 graph in FIG. 5B. BOP 64 also has a relationship with EDD Score 46. A droplet 30 which takes a long time to break-off will be in contact with the printhead 26 longer, and therefore will build up a larger charge than a droplet 30 which breaks off sooner. Since a higher charge on the ink droplets 30 corresponds to a higher EDD Score 46, FIG. 6 illustrates that EDD Score 46 will increase 68 with longer BOP 64. Thus, a three-dimensional model 70 may be arrived at with variables of BOP 64, EDD Score 46, and EDD Phase 48. A possible three dimensional shape for this BOP 64 relationship is illustrated in FIG. 6, although the exact nature of the three-dimensional relationship may vary with ink formulations and printing systems, and may need to be determined empirically or with adequate modeling of known ink compositions.

EDD Score 46 and an EDD Phase 48 may be calculated as indicated above for an ink droplet 30 or an ink burst 40 containing multiple droplets 30. EDD Score 46 has a quantifiable relationship with ink conductivity 54 and ink drop size 56. EDD Phase 48 has a quantifiable relationship with turn-on-energy (TOE) 58 and ink drop velocity 60. Ink system characteristics such as break-off point (BOP) 64, as well as ink viscosity, surface tension, dye load, and ink age, have a quantifiable relationship with both EDD Score 46 and EDD Phase 48. Given these various relationships which exist between the ink system characteristics, and which may be predetermined, a printing mechanism 20 may be configured to detect and determine changes in the ink properties or changes in the ink system characteristics and make adjustments to ink drop generator 24 firing voltages, printing speeds (determined among other things by printhead 26 firing frequencies and ink drop generator 24 velocity in a reciprocating ink drop generator 24 system), ink drop size, ink drop placement, and other image quality attributes within the controller's 22 control to optimize print quality for the type of ink being used.

Figure 7:
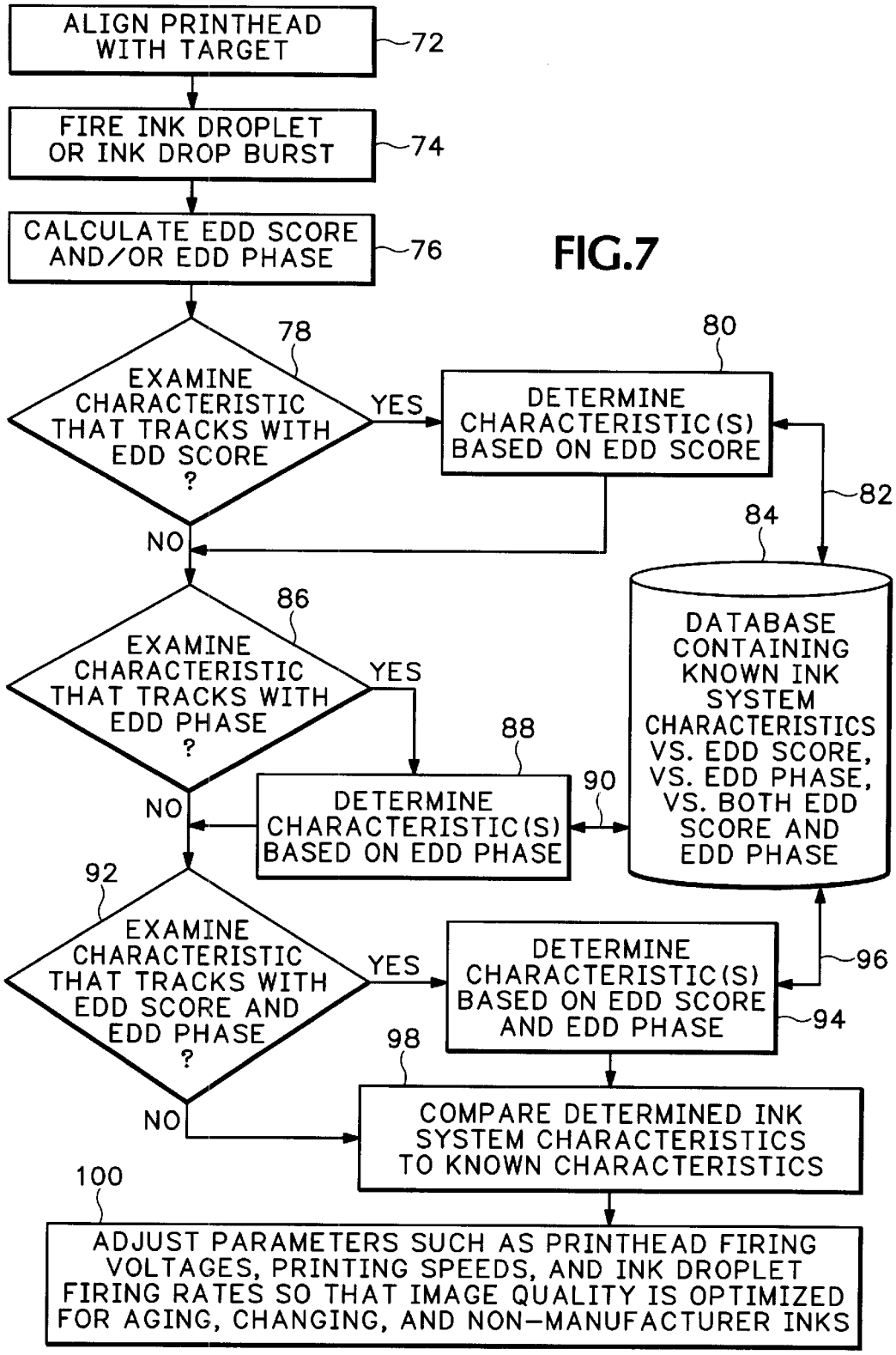
FIG. 7 illustrates an embodiment by which a determined electrostatic drop detection score and phase may be used to optimize image quality for use with various types of ink.

FIG. 7 illustrates a process by which EDD Score 46 and EDD Phase 48 may be used in a printer 20 to optimize image quality for use with any inks. The printhead 26 may be aligned 72 with the conductive target 34. An ink droplet 30 or an ink drop burst 40 may be fired 74 from the printhead 26. An EDD Score 46 and an EDD Phase 48 may each or both be calculated 76, depending on what ink system characteristics are of interest. If it is desired 78 to examine an ink system characteristic which tracks with EDD Score 46, such as ink conductivity 54 or drop size 56, then these characteristics may be determined 80 by reference 82 with a database 84 containing values for known ink system characteristics versus EDD Score 46. If it is desired 86 to examine an ink system characteristic which tracks with EDD Phase 48, such as turn-on-energy (TOE) 58 or ink velocity 60, then these characteristics may be determined 88 by reference 90 with a database 84 containing values for known ink system characteristics versus EDD Phase 48. If it is desired 92 to examine an ink system characteristic which tracks with respect to both EDD Score 46 and EDD Phase 48, such as break-off-point (BOP) 64, then such a characteristic may be determined 94 by reference 96 with a database 84 containing values for known ink system characteristics versus both EDD Score 46 and EDD Phase 48. The determined ink system characteristics can be compared 98 to known ink system characteristics, and then parameters such as printhead firing voltages, printing speeds, and ink droplet firing rates may be adjusted 100 by the controller 22 to optimize image quality for aging, changing, or non-manufacturer inks. Such optimization will tend to minimize the variability of ink drop size and ink drop placement, as well as allow a particular drop size to be selected at a maximized drop firing rate.

Figure 8:
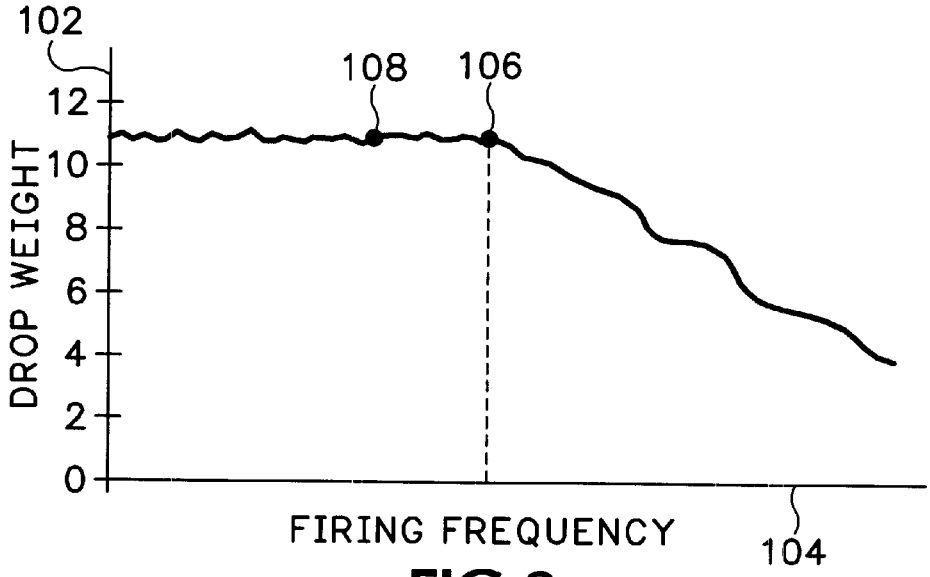
FIG. 8 illustrates a possible graph of ink drop generator firing frequency versus resultant ink drop weight.

FIG. 8 illustrates a typical graph of ink drop weight 102 versus printhead firing frequency 104. This type of graph is typically generated manually during the development stage of a printing system by varying the printhead firing frequency 104 and weighing drop samples. This process is not practical or economical to perform in a printing mechanism.

As the graph in FIG. 8 illustrates, the drop weight 102 typically stays relatively constant as firing frequency 104 is increased until a pivotal firing frequency 106 is reached. Beyond this pivotal firing frequency 106, as firing frequency 104 increases, the drop weight 102 will start to significantly decrease. This occurs due to the fact that the ink chambers in the printhead 26 are no longer able to refill completely before a new firing signal is received at the higher firing frequencies 104. Although it would be ideal to operate at the pivotal firing frequency 106, a nominal firing frequency 108, considerably less that the pivotal firing frequency 106, is typically chosen to ensure consistency of ink drop size and weight despite ink characteristics which may change over time. Having a predictable ink drop size and weight enables high image quality. Operating at the nominal firing frequency 108, which is slower than the pivotal firing frequency 106, may result in slower throughput (printed pages per minute) than if the pivotal firing frequency 106 was used. This has been an acceptable tradeoff in the interest of consistent image quality despite the likelihood that ink characteristics may change.

Figure 9:
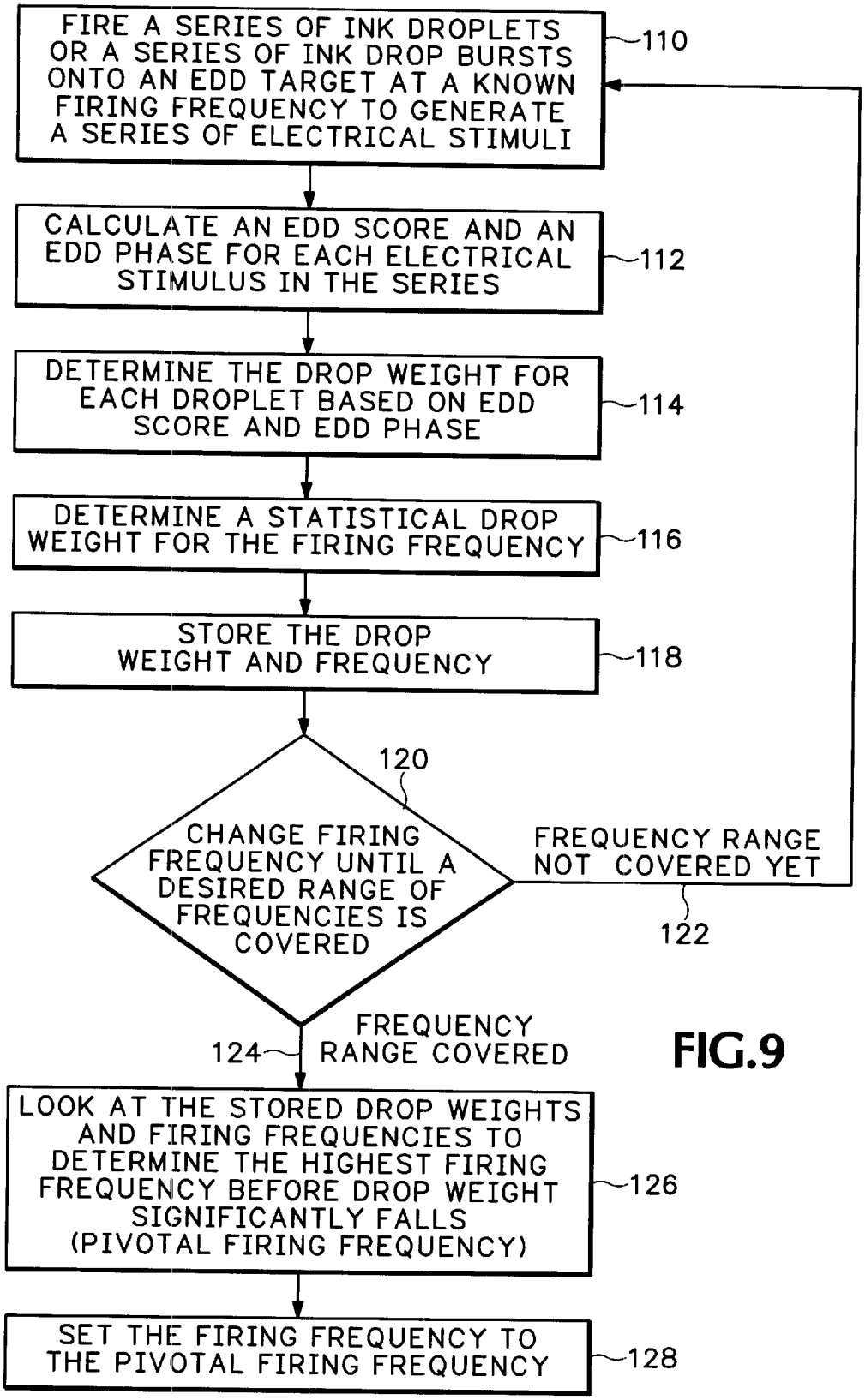
FIG. 9 illustrates an embodiment by which an optimized firing frequency may be determined for an ink drop generator.

However, using the embodiments described herein, and their equivalents, firing frequency 104 may now be varied and drop size 56 and drop weight 102 calculated automatically at several frequencies. FIG. 9 illustrates an embodiment of a process by which this may be accomplished. A series of ink droplets 30 or a series of ink drop bursts may be fired 110 onto an electrostatic drop detector target at a known firing frequency to generate a series of electrical stimuli. An EDD Phase 48 and an EDD Score 46 may be calculated 112 for each electrical stimulus in the series. A drop weight may be determined 114 for each ink droplet based on the EDD Scores 46 and EDD Phases 48. A statistical drop weight may be determined 116 for the known firing frequency. The statistical drop weight may be an average of drop weight values in the series, a windowed average, a mean drop weight, or other appropriate statistical measurement which is well within the means of a person of ordinary skilled in the art to determine. The statistical drop weight may be stored 118 with a corresponding known firing frequency in a dataset for further examination. The firing frequency may then be changed 120 and the previous steps 110, 112, 114, 116, and 118 may be repeated 122 until a desired range of firing frequency 104 is covered. When the desired range of firing frequency is covered 124, the highest firing frequency before which drop weight significantly falls may be determined 126 by looking at the stored dataset of drop weight values and firing frequencies. The highest frequency before which drop weight significantly falls is the pivotal firing frequency 106. The printer may be set 128 to operate at this pivotal firing frequency 106 to obtain the highest possible throughput (printed pages per minute) given the inks currently installed in the product. The printer controller may automatically and periodically re-determine the pivotal firing frequency 106, using a process like the embodiment of FIG. 9, to ensure that the highest image quality at the highest throughput is being realized. This allows the printer to adjust to aging or changing inks and printheads, as well as allowing the printer to work well with inks from other manufacturers or new inks from the printer manufacturer which were unavailable at the time the printer 20 was built.

Ink usage measurements can also benefit from the ability of a printer 20 to accurately calculate ink drop size 56. Previous attempts to track ink usage from a given ink drop generator 24 have been based on drop counting techniques. At first, these drop counting techniques were simply keyed off of the controller's 22 firing command signals 28. Each time a nozzle was told to fire, a counter was incremented inside of the controller 22. Based on a knowledge of an ink drop generator's 24 starting ink volume, an assumption regarding the average drop size, and an assumption that when a nozzle was told to fire that it actually did fire, an estimate of ink usage could be arrived at. Unfortunately, nozzles do not always fire due to resistor failure or clogging, and drop size may significantly vary from one ink formulation to another, from one ink drop generator 24 to another, and by ink manufacturer. This results in an inaccurate ink usage measurement.

An different ink usage measurement system relied on a periodic check to determine if in fact the printhead 26 nozzles were firing. This was accomplished through the use of a low cost ink drop detector, such as the one employed in U.S. Pat. No. 6,086,190. A sequence of firing command control signals 28 were sent from the controller 22 to the ink drop generator 24 to cause the printhead 26 nozzles to fire ink droplets. The controller 22 was able to track if an ink droplet was ejected from each printhead 26 nozzle as requested by looking for corresponding signals from the ink drop detector. As a result, the ink usage measurement is more accurate in this type of system because non-firing nozzles were not counted. Unfortunately, this type of measurement still takes into account an assumption of ink drop size. Ink drop size, however, may vary and the result is a less than accurate ink usage measurement.

Using the embodiments and their equivalents disclosed herein, it is possible to not only know whether a printhead 26 nozzle is functioning, but also to know what ink drop size is being ejected from each nozzle on the printhead. By periodically updating this information, a highly accurate ink usage measurement may be made tracking the actual volume of ink which is ejected from an ink drop generator 24. Operators of a printer 20 may then either track their ink usage or receive accurate warning that they will soon need to replace the ink supplies in the printer 20.

An ink drop detector 32 may be used to determine ink system characteristics, enabling a printing mechanism to reliably use ink drop detection readings to provide users with consistent, high-quality, and economical inkjet output despite printheads 26 which may clog over time and despite ink formulations which may change, age, or are supplied from another manufacturer. In discussing various embodiments of ink system characteristic identification, various benefits have been noted above.

Although the ink system characteristics described herein include ink conductivity, ink drop size, ink drop weight, ink drop velocity, turn-on-energy, break-off-point, viscosity, dye-load, surface tension, and age of the ink, it is apparent that other ink system characteristics may be determined with relation to EDD Score, EDD Phase, or EDD Score in conjunction with EDD Phase. Such ink system characteristics are deemed to be within the scope of the claims below. Additionally, it is apparent that a variety of other structurally and functionally equivalent modifications and substitutions may be made to determine ink system characteristics according to the concepts covered herein depending upon the particular implementation, while still falling within the scope of the claims below.

We claim:

1. An ink drop detector, comprising:

a sensing target which is imparted with an electrical stimulus when struck by at least one ink drop burst which has been ejected from an ink drop generator; and electronics coupled to the sensing target which characterize the electrical stimulus in terms of a mathematical phase, wherein the mathematical phase indicates at least one ink system characteristic.

2. The ink drop detector of claim 1, wherein the electronics further comprise:

circuitry coupled to the sensing target to produce a filtered and amplified signal from the electrical stimulus; and a processor coupled to the circuitry which characterizes the filtered and amplified signal in terms of a mathematical phase.

3. The ink drop detector of claim 1, wherein the ink system characteristic is an ink drop velocity.

4. The ink drop detector of claim 1, wherein the ink system characteristic is a turn-on-energy for the ink drop generator.

5. The ink drop detector of claim 1, wherein the electronics coupled to the sensing target further characterize the electrical stimulus in terms of a mathematical phase and in terms of a mathematical vector.

6. The ink drop detector of claim 5, wherein the electronics further comprise:

circuitry coupled to the sensing target to produce a filtered and amplified signal from the electrical stimulus; and a processor coupled to the circuitry which characterizes the filtered and amplified signal in terms of a mathematical phase and in terms of a mathematical vector.

7. The ink drop detector of claim 6, wherein:

the mathematical phase indicates at least one phase-based ink system characteristic; and the mathematical vector indicates at least one vector-based ink system characteristic.

8. The ink drop detector of claim 7, wherein the vector-based ink system characteristic is an ink conductivity.

9. The ink drop detector of claim 7, wherein the vector-based ink system characteristic is an ink drop size.

10. The ink drop detector of claim 7, wherein the vector-based ink system characteristic is an ink drop weight.

11. The ink drop detector of claim 6, wherein the mathematical phase and the mathematical vector are used in conjunction to indicate at least one ink system characteristic.

12. The ink drop detector of claim 11, wherein the ink system characteristic is an ink drop break off point.

13. The ink drop detector of claim 11, wherein the ink system characteristic is an ink drop viscosity.

14. The ink drop detector of claim 9, wherein the ink system characteristic is an ink drop surface tension.

15. The ink drop detector of claim 11, wherein the ink system characteristic is an ink drop dye load.

16. The ink drop detector of claim 11, wherein the ink system characteristic is an age of the ink.

17. The ink drop detector of claim 1, wherein the mathematical phase is approximated by a phase ratio.

18. The ink drop detector of claim 17, wherein the phase ratio indicates at least one ink system characteristic.

19. A method for analyzing ink ejected from an ink drop generator, comprising:

generating an electrical stimulus on an ink drop detector target by firing at least one ink droplet onto the target;

calculating a mathematical phase based on the electrical stimulus; and determining an ink system characteristic based on the mathematical phase.

20. The method of claim 19, wherein determining an ink system characteristic based on the mathematical phase comprises determining an ink drop velocity.

21. The method of claim 19, wherein determining an ink system characteristic based on the mathematical phase comprises determining a turn-on energy for the ink drop generator.

22. The method of claim 19, further comprising:

comparing the ink system characteristic to known ink system characteristics; and adjusting parameters of the ink drop generator to optimize image quality.

23. The method of claim 22, wherein adjusting parameters of the ink drop generator to optimize image quality comprises adjusting a firing voltage of the ink drop generator.

24. The method of claim 22, wherein adjusting parameters of the ink drop generator to optimize image quality comprises adjusting a reciprocating velocity of the ink drop generator.

25. The method of claim 22, wherein adjusting parameters of the ink drop generator to optimize image quality comprises adjusting a firing rate of the ink drop generator.

26. The method of claim 22, wherein adjusting parameters of the ink drop generator to optimize image quality comprises making adjustments to optimize image quality for changing or unexpected ink properties as a result of new ink, aging ink, variations in ink composition, or a use of non-manufacturer ink.

27. The method of claim 17, further comprising:

calculating a mathematical vector based on the electrical stimulus; and determining an ink system characteristic based on the mathematical vector.

28. The method of claim 27, wherein determining an ink system characteristic based on the mathematical vector comprises determining an ink conductivity.

29. The method of claim 27, wherein determining an ink system characteristic based on the mathematical vector comprises determining an ink drop size.

30. The method of claim 29, further comprising:

using the determined ink drop size to make drop-based ink usage measurements more accurate.

31. The method of claim 27, wherein determining an ink system characteristic based on the mathematical vector comprises determining an ink drop weight.

32. The method of claim 27, further comprising:

comparing the ink system characteristic to known ink system characteristics; and adjusting parameters of the ink drop generator to optimize image quality.

33. The method of claim 32, wherein adjusting parameters of the ink drop generator to optimize image quality comprises adjusting a firing voltage of the ink drop generator.

34. The method of claim 32, wherein adjusting parameters of the ink drop generator to optimize image quality comprises adjusting a reciprocating velocity of the ink drop generator.

35. The method of claim 32, wherein adjusting parameters of the ink drop generator to optimize image quality comprises adjusting a firing rate of the ink drop generator.

36. The method of claim 32, wherein adjusting parameters of the ink drop generator to optimize image quality comprises making adjustments to optimize image quality for changing or unexpected ink properties as a result of new ink, aging ink, variations in ink composition, or a use of non-manufacturer ink.

37. The method of claim 19, wherein calculating the mathematical phase based on the electrical stimulus comprises approximating the mathematical phase with a phase ratio.

38. The method of claim 19, wherein calculating the mathematical phase based on the electrical stimulus comprises:

sampling the electrical stimulus at substantially equal intervals; and performing digital signal processing based on the sampling.

39. The method of claim 19, wherein calculating the mathematical phase based on the electrical stimulus comprises:

sampling the electrical stimulus at non-equal intervals; and performing digital signal processing based on the sampling.

40. A method for analyzing ink ejected from an ink drop generator, comprising:

generating an electrical stimulus on an ink drop detector target by firing at least one ink droplet onto the target;

calculating a mathematical phase based on the electrical stimulus;

calculating a mathematical vector based on the electrical stimulus;

determining an ink system characteristic based on both the mathematical phase and the mathematical vector.

41. The method of claim 40, wherein determining an ink system characteristic based on both the mathematical phase and the mathematical vector comprises determining an ink drop break off point.

42. The method of claim 40, wherein determining an ink system characteristic based on both the mathematical phase and the mathematical vector comprises determining an ink drop viscosity.

43. The method of claim 40, wherein determining an ink system characteristic based on both the mathematical phase and the mathematical vector comprises determining an ink drop surface tension.

44. The method of claim 40, wherein determining an ink system characteristic based on both the mathematical phase and the mathematical vector comprises determining an ink drop dye load.

45. The method of claim 40, wherein determining an ink system characteristic based on both the mathematical phase and the mathematical vector comprises determining an ink age.

46. The method of claim 40, further comprising:

comparing the ink system characteristic to known ink system characteristics; and adjusting parameters of the ink drop generator to optimize image quality.

47. The method of claim 46, wherein adjusting parameters of the ink drop generator to optimize image quality comprises adjusting a firing voltage of the ink drop generator.

48. The method of claim 46, wherein adjusting parameters of the ink drop generator to optimize image quality comprises adjusting a printing speed of the ink drop generator.

49. The method of claim 46, wherein adjusting parameters of the ink drop generator to optimize image quality comprises adjusting a firing rate of the ink drop generator.

50. The method of claim 46, wherein adjusting parameters of the ink drop generator to optimize image quality comprises making adjustments to optimize image quality for changing or unexpected ink properties as a result of new ink, aging ink, variations in ink composition, or a use of non-manufacturer ink.

51. The method of claim 40, wherein calculating the mathematical phase based on the electrical stimulus comprises approximating the mathematical phase with a phase ratio.

52. The method of claim 40, further comprising:

sampling the electrical stimulus at substantially equal intervals;

wherein calculating a mathematical phase based on the electrical stimulus comprises performing digital signal processing based on the sampling; and wherein calculating a mathematical vector based on the electrical stimulus comprises performing digital signal processing based on the sampling.

53. The method of claim 40, further comprising:

sampling the electrical stimulus at non-equal intervals;

wherein calculating a mathematical phase based on the electrical stimulus comprises performing digital signal processing based on the sampling; and wherein calculating a mathematical vector based on the electrical stimulus comprises performing digital signal processing based on the sampling.

54. A method for optimizing ink drop generator firing frequency, comprising:

generating a series of electrical stimuli by firing a series of ink droplets or a series of ink drop bursts onto an electrostatic drop detector target at a known firing frequency;

calculating a mathematical phase for each electrical stimulus;

calculating a mathematical vector for each electrical stimulus;

determining a statistical ink drop weight for ink drops fired at the known firing frequency based on the mathematical phase and mathematical vector associated with each stimulus;

storing the statistical ink drop weight with corresponding known firing frequency in a dataset for further examination;

changing the known firing frequency to a different known firing frequency;

repeating the preceding steps until a desired firing frequency range is covered;

examining the stored dataset comprising pairs of ink drop weights and known firing frequencies to determine a pivotal firing frequency before which the ink drop weight starts to decline enough to affect image quality, setting the firing frequency to the pivotal firing frequency.

* * * * *